United States Patent [19]

Matoba

[11] Patent Number: 5,040,781

[45] Date of Patent: Aug. 20, 1991

[54] SHEET MEMBER FEEDING APPARATUS HAVING CUT-OUTS TO PROTECT DOCUMENT TIPS

[75] Inventor: Takeshi Matoba, Yokohama, Japan

[73] Assignee: Canon Kabushiki Kaisha, Tokyo, Japan

[21] Appl. No.: 350,345

[22] Filed: May 11, 1989

[30] Foreign Application Priority Data

May 12, 1988 [JP] Japan ..... 63-116374

[51] Int. Cl.[5] ..... B65H 9/00

[52] U.S. Cl. ..... 271/242; 271/2; 271/272

[58] Field of Search ..... 271/2, 16, 109, 119, 271/226, 242, 245, 272–274

[56] References Cited

U.S. PATENT DOCUMENTS

| | | | |
|---|---|---|---|
| 3,495,821 | 2/1970 | Raterman | 271/272 |
| 3,545,371 | 12/1970 | Reist | 271/272 |
| 3,954,261 | 5/1976 | Greene et al. | 271/272 |
| 4,188,025 | 2/1980 | Gusfafson et al. | 271/272 |
| 4,645,192 | 2/1987 | Watanabe | 271/242 |

FOREIGN PATENT DOCUMENTS

| | | | |
|---|---|---|---|
| 118542 | 6/1985 | Japan | 271/226 |
| 230472 | 9/1988 | Japan | 271/272 |

*Primary Examiner*—Robert P. Olszewski
*Assistant Examiner*—Steve Reiss
*Attorney, Agent, or Firm*—Fitzpatrick, Cella, Harper & Scinto

[57] ABSTRACT

The present invention is related to a sheet member feeding apparatus for feeding a sheet member such as an envelope. The feeding apparatus has a pair of opposed contacted rotary members such as rollers and comprising a releasing member for releasing the contact between the rotary members provided on at least one of the rotary members in areas where front corners of the sheet member pass through. The feeding apparatus is applicable to a printing system, reader system and the like.

9 Claims, 7 Drawing Sheets

SHEET MEMBER FEEDING APPARATUS HAVING CUT-OUTS TO PROTECT DOCUMENT TIPS

BACKGROUND OF THE INVENTION

1. Field of the Invention

The present invention relates to a sheet member feeding apparatus which can smoothly feed a sheet member including an envelope and the like, without jamming.

2. Related Background Art

A regist feeding portion in a conventional sheet member feeding apparatus for feeding a sheet member or material including an envelope and the like comprises, as shown in FIG. 1, a metallic roller 1 and a rubber roller 2 which are engaged by each other to rotate and stop altogether.

Explaining an operation of such conventional mechanism, in a condition that the metallic roller 1 and the rubber roller 2 are maintained stationary, a leading edge 31 of an envelope 3 fed through a guide member (not shown) such as a guide plate is first abutted against an outer peripheral surface of the metallic roller 1 and then is gradually sent toward a nip portion 5 between the metallic roller 1 and the rubber roller 2 along the outer peripheral surface of the metallic roller 1. Further, since the envelope 3 is fed by a predetermined distance by means of a sending means (not shown) acting on a trailing edge 32 of the envelope, a predetermined amount of loop is formed in the envelope 3. Even if the envelope is skew-fed with either one of left and right corners of the leading edge 31 being ahead of the other, the difference in amount created in the skew feeding is absorbed during the loop formation, and, consequently, the left and right corners of the leading edge 31 of the envelope are abutted against the nip portion 5 between the rollers 1, 2, thus compensating for the skew feeding of the envelope. Thereafter, the envelope 3 is correctly fed to a desired position through the rotation of the metallic roller 1 and the rubber roller 2.

In some cases, as shown in FIG. 2, the envelope 3 has a protruding folded portion at a corner 41 thereof. In this case, when the envelope is skew-fed with the protruding corner 41 being ahead of the other corner, as shown in FIG. 3, the corner 41 having the protruding folded portion will first be engaged by the nip portion 5. However, if the protruding folded portion of the corner 41 is curled at a point 42, the protruding corner 41 is engaged only by the rubber roller 2, and, thus the curl 42 grows more and more (in a direction shown by an arrow A). Consequently, the corner 41 cannot reach the nip portion 5 between the metallic roller 1 and the rubber roller 2, with the result that the envelope is not fed even when the rollers 1 and, 2 are rotated, thus causing so-called "pre-regist jam".

SUMMARY OF THE INVENTION

It is an object of the present invention to provide a sheet member feeding apparatus for smoothly feeding a non-flat sheet such as an envelope, which can eliminate the aforementioned conventional drawback.

In order to achieve the above object, for example, explaining with reference to FIGS. 4 to 9, a sheet member feeding apparatus according to the present invention is characterized in that it includes a feed means comprising a pair of contacted rotary members (1, 6) or moving members 7 or combination thereof for feeding a sheet shaped original and an envelope (4) and that, in an area on at least either of the rotary members (1, 6) or the moving member (7) where a corner (41) of the envelope (4) passes through, a release means (61, 62, 71 and 72) for releasing the contact between such members is provided.

With this arrangement, even when the corner (41) of the envelope (4) has a protruding folded portion curled (at a portion 42), since the curled corner (41) is not abutted against the feed means, the curl (42) is not enhanced by the rotary member (6) or the moving member (7), whereby the envelope itself can be fed smoothly to a desired position.

In a sheet feeding apparatus according to the present invention, when the envelope is fed, the corner of the envelope is not obstructed by the feed means, thus preventing the occurrence of the so-called "pre-regist jam" and the like without fail, whereby the sheet member and the envelope can be fed stably and smoothly.

DESCRIPTION OF THE PREFERRED EMBODIMENTS

Figure 1:
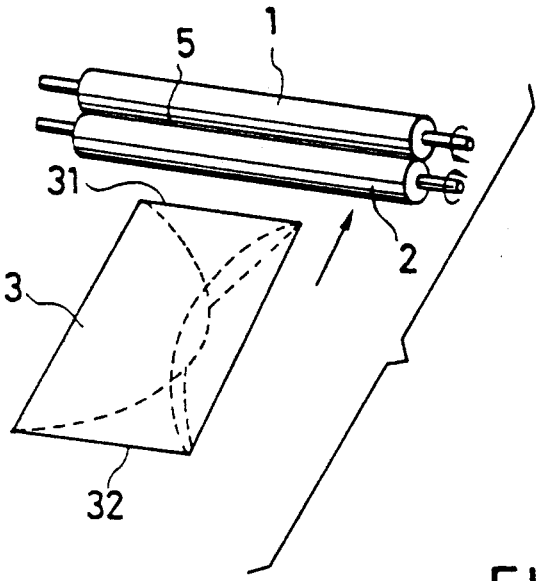
FIG. 1 is a perspective view of a conventional sheet member feeding apparatus.
Figure 2:
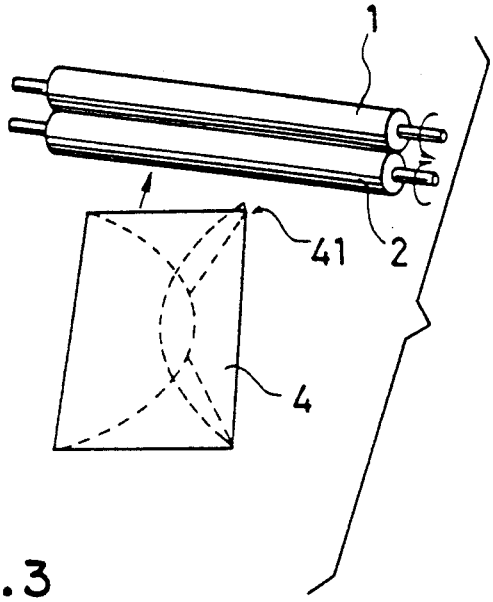
FIGS. 2 and 3 are views explaining drawback of the conventional feeding apparatus.
Figure 3:
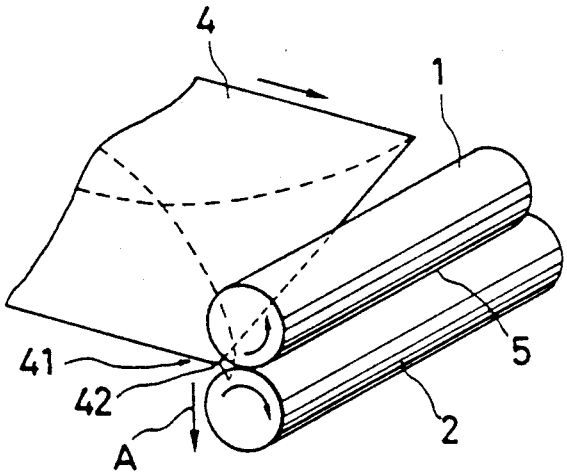

The present invention will now be explained in connection with embodiments with reference to the accompanying drawings. It should be noted that elements similar to those in a conventional apparatus are designated by the same reference numerals used in the explanation of the conventional apparatus (FIGS. 1–3).

Figure 4:
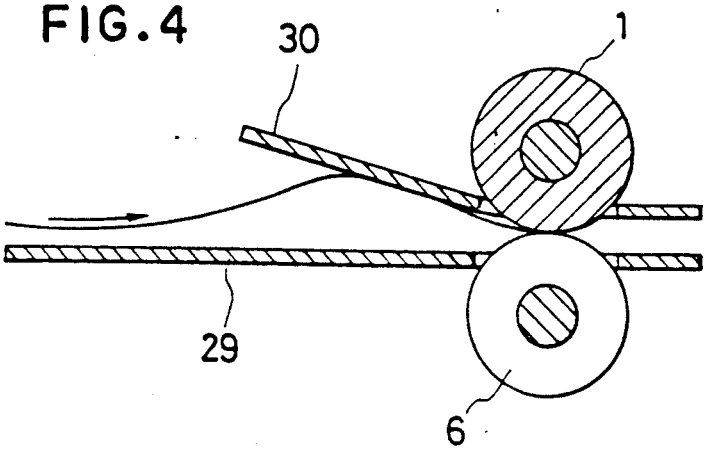
FIG. 4 is a sectional view of a main portion of a sheet member feeding apparatus according to the present invention.
Figure 5:
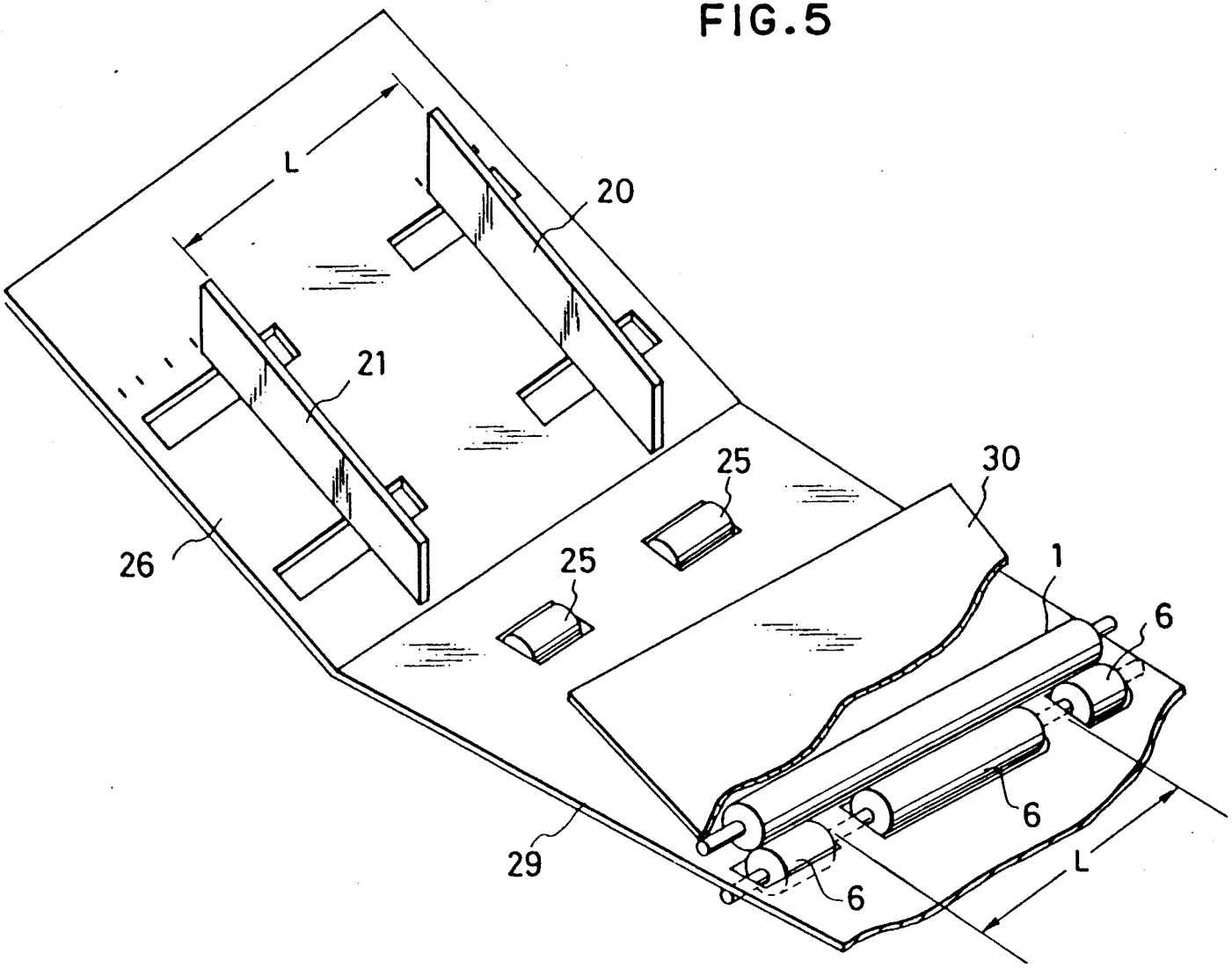
FIG. 5 is a perspective view of the feeding apparatus according to the present invention.
Figure 7:
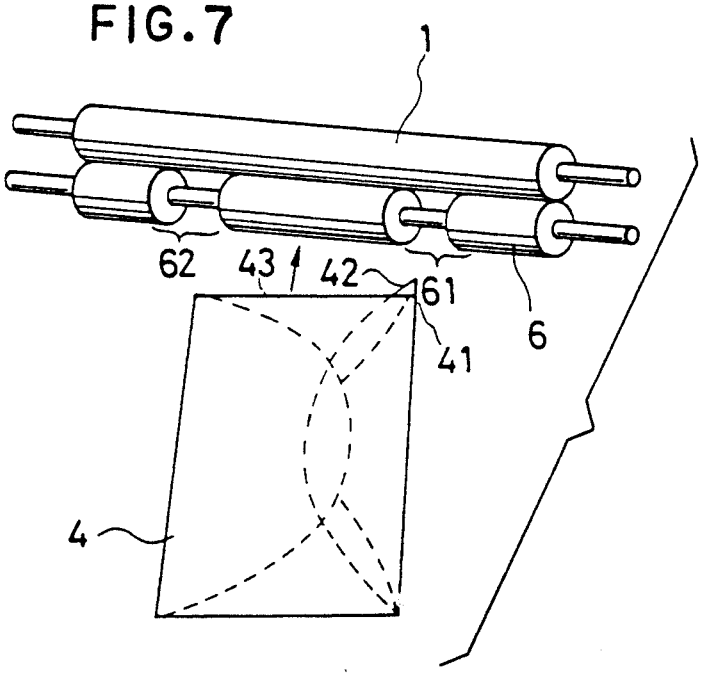
FIG. 7 is a view showing a condition of an envelope fed by the feeding apparatus of FIG. 6.

As shown in FIGS. 4, 5 and 7, a sheet member feeding apparatus comprises a metallic roller 1 and a rubber roller 6 pressed against the metallic roller 1. The rubber roller 6 has cut-outs 61 and 62 where corners 41 of the envelope 4 reached the rollers through guide members 20, 21 (such as guide plates) are passed through. The guide members 20 and 21 can be slidably adjusted by an operator to adjust a distance therebetween in correspondence to a size of the sheet member 4, and is adjusted in a positon (size L) shown in FIG. 5 when the envelope is fed. Accordingly, the cut-outs 61 and 62 of the rubber roller 6 are also designed to have a distance L between the centers of the cut-outs, so that the corners 41 of the envelope can pass through the cut-outs when the envelope is being fed. Incidentally, feed rollers 25 cooperate with corresponding upper feed rollers (not shown).

Therefore, the sheet member (including the envelope) manually positioned on a sheet support 26 is fed toward the rollers 1, 6 by means of the feed rollers 25 while being guided by upper and lower guide plates 29 and 30. In this point, since the rollers are now stationary (i.e., not rotated), a loop is formed in the sheet member.

Figure 6:
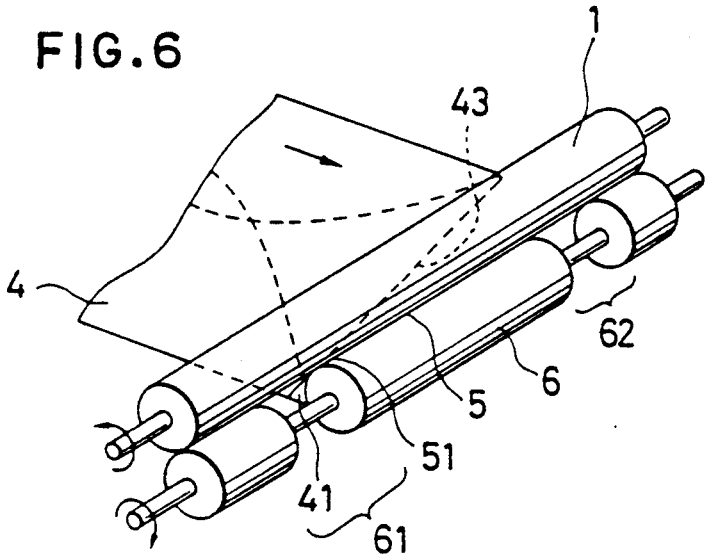
FIG. 6 is a perspective view of a main portion of the feeding apparatus according to the present invention.
Figure 8:
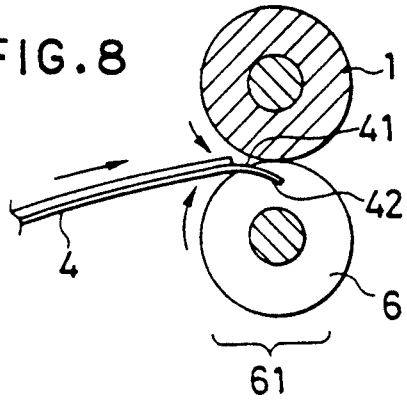
FIG. 8 is a sectional view of the feeding apparatus of FIG. 6.

Next, an operation of the sheet member feeding apparatus according to this embodiment will be explained also with reference to FIGS. 6 and 8.

It is assumed that the envelope 4 is skew-fed to the non-rotated metallic roller 1 and rubber roller 6 with the right (FIG. 6) front corner 41 of the envelope being ahead of the other (left) corner. In this case, if the right front corner 41 has a protruding folded portion which is curled downwardly at portion 42, since the right front corner 41 of the envelope 4 enters into the cut-out 61 of the rubber roller 6, as shown in FIG. 6, the corner does not abutt against the rubber roller 6, whereby the right front corner 41 can be advanced without being obstructed by the rollers (of course, when the left front corner is ahead of the right front corner of the envelope, the left corner first enters into the cut-out 62 of the rubber roller 6). Consequently, a front edge 43 of the envelope 4 can be abutted against the nip portion 5 between the metallic roller 1 and rubber roller 6 at a point 51 (FIG. 6), without enhancing the curl 42 of the folded portion at the corner 41, as shown in FIG. 8. And, the skew condition of the envelope 4 is gradually amended or corrected around the point 51 to finally abut the whole front edge 43 of the envelope against the nip portion 5. The corrected envelope 4 is then fed smoothly toward a downstream desired position by means of the metallic roller 1 and rubber roller 6 now being rotated. At the downstream side of the rollers 1 and 6, the sheet member may be printed by an appropriate printer or if the sheet member is the original (although not shown), the original may be read by an appropriate reader. That is to say, the present invention is applicable to a printing system, reader system and the like.

Figure 9:
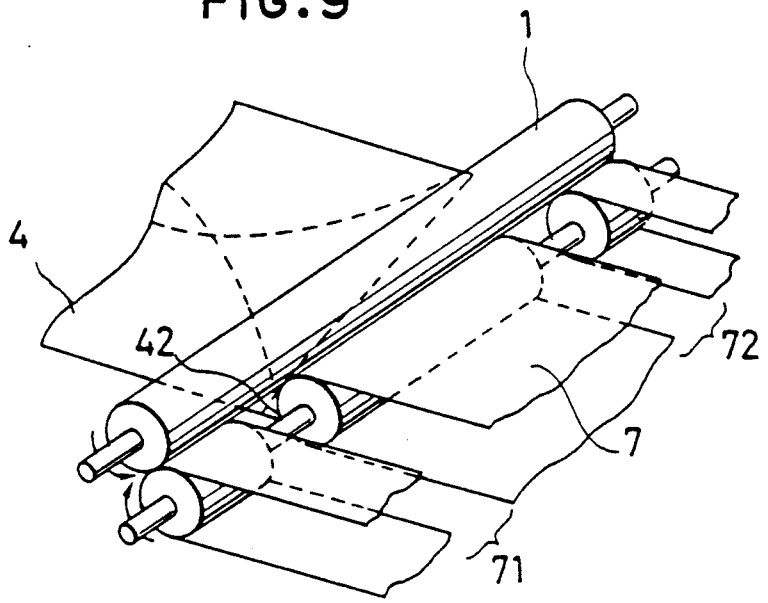
FIG. 9 is a perspective view of a main portion of a sheet member feeding apparatus according to another embodiment of the present invention.

As mentioned above, while the present invention was explained with respect to the embodiment wherein the sheet member feeding apparatus has a pair of rollers (rotary members), the present invention is not limited to such an embodiment, but may include a pair of upper and lower rotatably moving members such as belts in place of the rotary members. In this case, one of the belts has cut-outs through which the corners of the envelope can pass, thus releasing the contact between the belts at cut-outs. Further, as shown in FIG. 9 in place of one of the rollers 1, 6 (the rubber roller 6 in the example of FIG. 9), a conveyance belt 7 having cut-outs 71 and 72 may be used.

Figure 10:
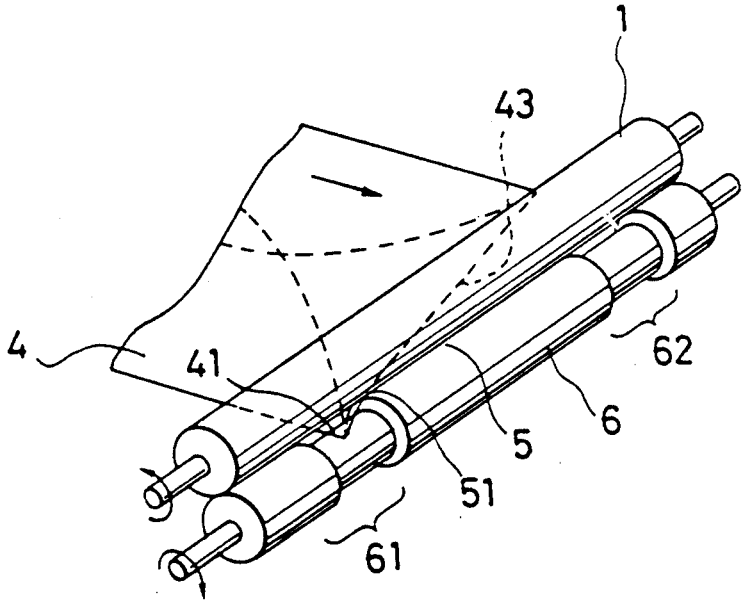
FIGS. 10 to 13 are perspective views showing other embodiments of the present invention, respectively.
Figure 11:
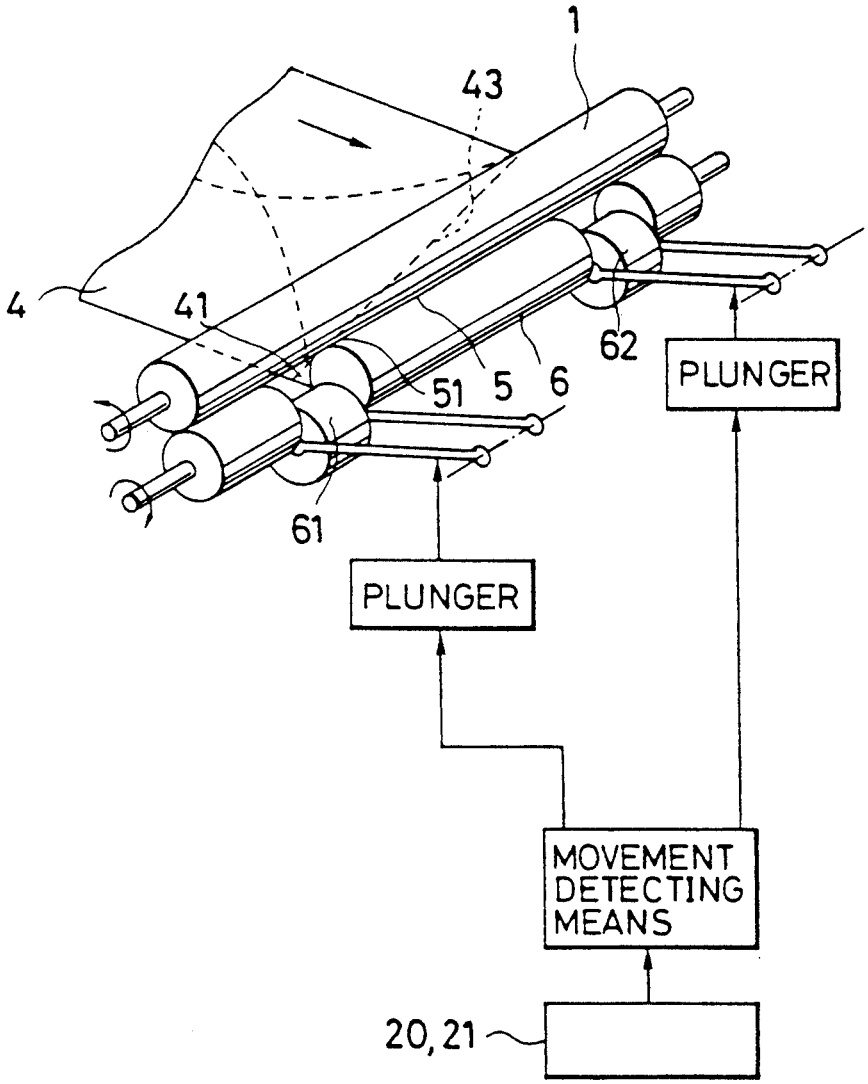

Further, in the illustrated embodiment, as a means for releasing the contact between the rollers, while the cut-outs were shown, such means is not limited to such cut-outs. For example, additional smaller rollers may be arranged in place of the cut-outs (FIG. 10). Alternatively, roller portions corresponding to the cut-out portions 61, 62 may be displaced away only when the envelope is being fed (FIG. 11). In this case, the roller portions can be shifted away by means of corresponding plungers, and the movement of such roller portions can be checked by movement detecting means.

Figure 12:
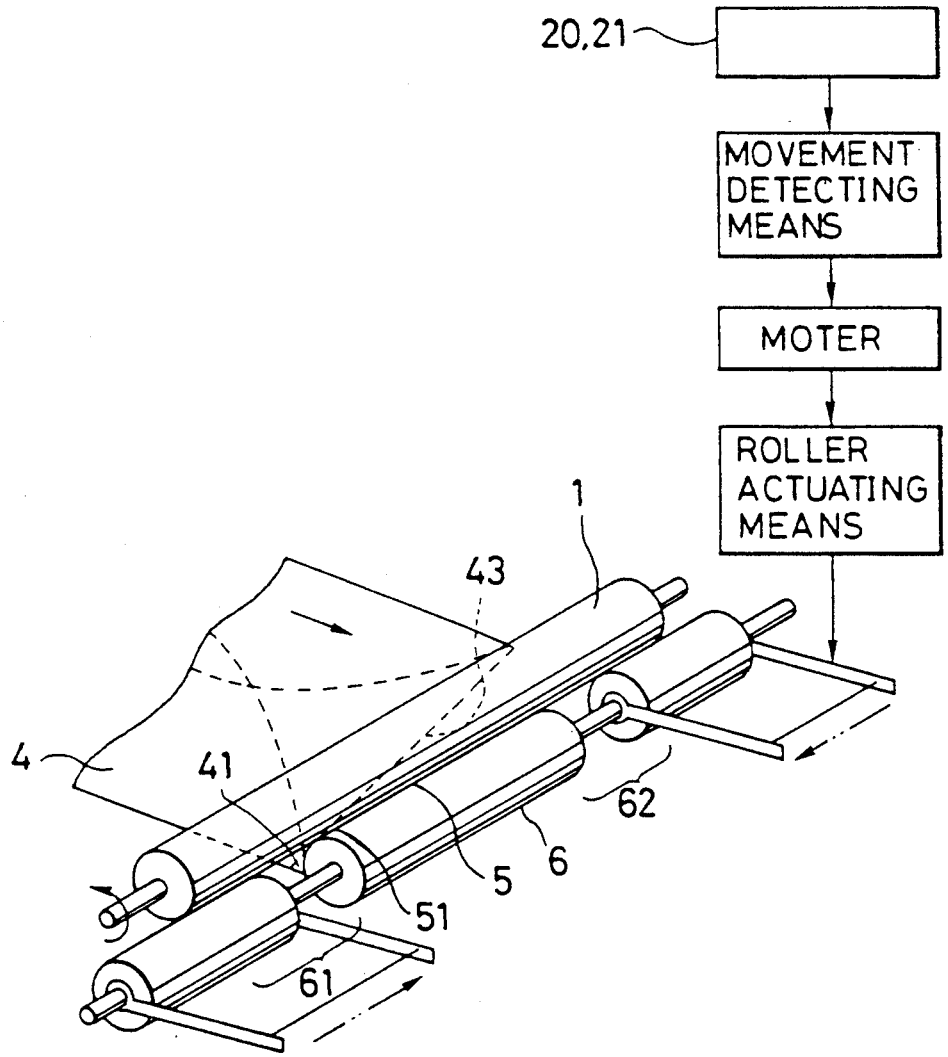
Figure 13:
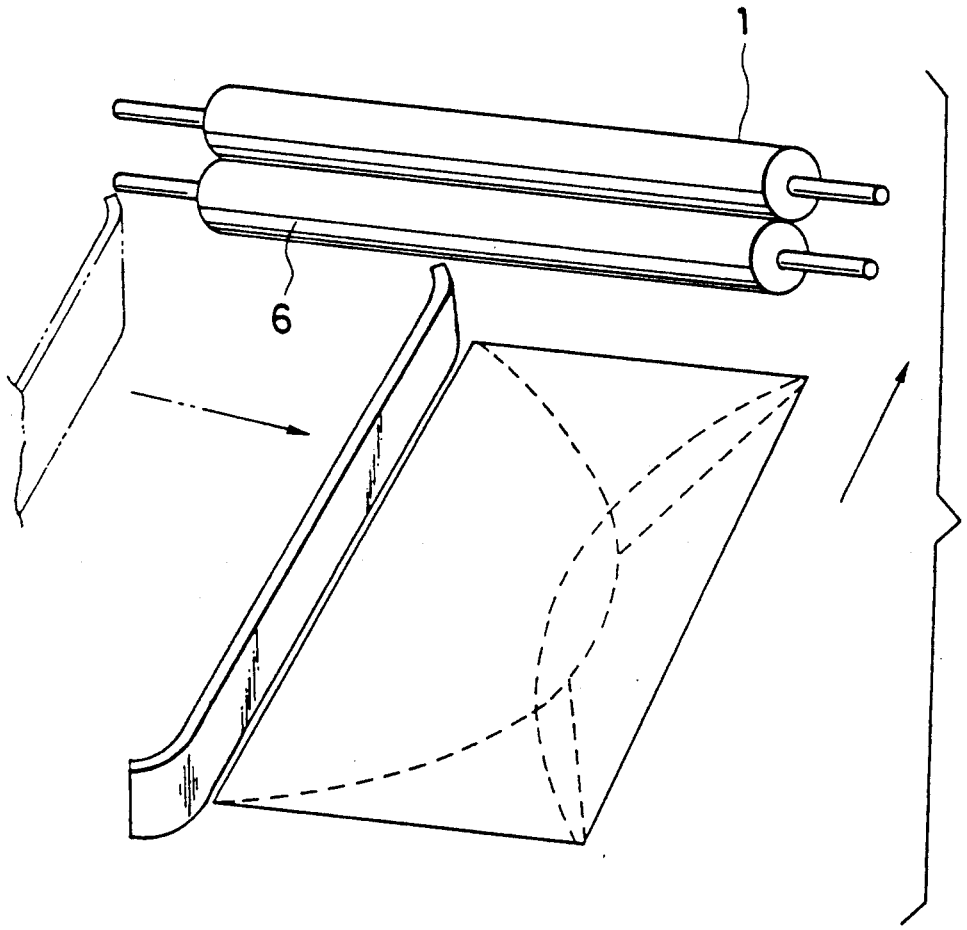

In addition, means for releasing the contact between the rollers may comprise end roller portions which can be shifted in a longitudinal direction of the rubber roller 6 to provide cut-outs 61, 62 according to the size of the sheet member (FIG. 12). In this case, the end roller portions can be shifted longitudinally by means of a roller actuating means driven by a motor, and the movement of such end roller portions can be checked by a movement detecting means. Finally, the guide plates 20, 21 may be shifted laterally to face the corner of the envelope with the means for releasing the contact between the rollers (FIG. 13). In this case, a print start position in the printer is shifted accordingly.

As mentioned above, while an example that the sheet member is positioned on the basis of a central reference position was explained, the present invention can be applied in the case where the sheet member is positioned on the basis of a side reference position.

Further, means for releasing the contact between the rollers may be provided on both of the paired rollers, as well as one of them (for example, lower roller).

I claim:

1. A sheet member feeding apparatus for feeding a sheet member such as an envelope, comprising:

an upper rotary member; and a lower rotary member in opposed contacting relation with the upper rotary member, and a cut-out formed thereon for eliminating the contact between said rotary members in an area where a corner of said sheet member passes through;

wherein said pair of rotary members constitute registering means for receiving a tip end of the sheet member while said rotary members are stationary and correcting a skew of the sheet member before starting sheet member feeding synchronous with a printing operation.

2. A sheet member feeding apparatus according to claim 1, further including guiding means for guiding said sheet member to a position wherein a corner of said sheet member extends into an area of said lower rotary member where said cut-out is provided.

3. A sheet member feeding apparatus according to claim 1, wherein said pair of rotary members comprise belts.

4. A sheet member feeding apparatus according to claim 1, wherein said pair of rotary members comprise rollers.

5. A sheet member feeding apparatus according to claim 1, wherein at least one of said paired rotary members comprises a belt.

6. A sheet member feeding apparatus according to claim 1, wherein said pair of rotary members are arranged in a printing system.

7. A sheet member feeding apparatus according to claim 1, wherein said pair of rotary members are arranged in a reader system.

8. A sheet member feeding apparatus according to claim 1, further including a guide provided at an upstream side of the rotary members for guiding the sheet member, said guide being shiftable in response to the size of the sheet member to align said sheet member with the cut-out.

9. A sheet member feeding apparatus for feeding a sheet member such as an envelope, comprising:

an upper rotary member;

a lower rotary member in opposed contacting relation with the upper rotary member, and a cut-out formed thereon for eliminating the contact between said rotary members in an area where a corner of said sheet member passes through, wherein said cut-out is formed by releasing means for shifting portions of said rotary member in an up-down direction, and further including a guide provided at an upstream side of the rotary members for guiding the sheet member, said guide being shiftable in response to the size of the sheet to align said sheet member with the cut-out.

* * * * *

UNITED STATES PATENT AND TRADEMARK OFFICE

CERTIFICATE OF CORRECTION

PATENT NO. : 5,040,781

DATED : August 20, 1991

INVENTOR(S) : Takeshi Matoba

It is certified that error appears in the above-identified patent and that said Letters Patent is hereby corrected as shown below:

SHEET 6 OF 7,
Fig. 12, "MOTER" should read --MOTOR--.

COLUMN 1,
Line 67, "moving members 7" should read --moving members (7)--.

COLUMN 3,
Line 17, "abutt" should read --abut--.

Signed and Sealed this

Ninth Day of March, 1993

*Attest:*

STEPHEN G. KUNIN

*Attesting Officer*

*Acting Commissioner of Patents and Trademarks*